US006354640B2

(12) United States Patent
Xie et al.

(10) Patent No.: US 6,354,640 B2
(45) **Date of Patent: *Mar. 12, 2002**

(54) HANDLE

(75) Inventors: Ming Xing Xie; Hon Wah Koh, both of Singapore (SG)

(73) Assignee: Diethelm Industries PTE Ltd. (SG)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/251,207

(22) Filed: Feb. 16, 1999

(51) Int. Cl.[7] ..... E05B 3/00
(52) U.S. Cl. ..... 292/336.3; 292/34
(58) Field of Search ..... 292/336.3, 34, 292/37, 40, 169, 165, 140, 143, 347; 70/211, 212, 215, 192, 193

(56) References Cited

U.S. PATENT DOCUMENTS

| | | | | | |
|---|---|---|---|---|---|
| 248,847 | A | * | 11/1881 | Clime | 292/140 |
| 345,665 | A | * | 7/1886 | Bourke | 292/140 |
| 452,269 | A | * | 5/1891 | Haueisen | 292/140 |
| 1,618,752 | A | * | 2/1927 | Cragg | 70/215 |
| 1,836,209 | A | * | 12/1931 | Viehweger | 292/37 |
| 1,901,613 | A | * | 3/1933 | Smith | 292/37 |
| 1,908,980 | A | * | 5/1933 | Heyal | 292/34 |
| 3,027,183 | A | * | 3/1962 | Schlage | 292/140 |
| 4,099,756 | A | | 7/1978 | Kagoura | 292/336.3 |
| 4,175,781 | A | | 11/1979 | Dumortier | 292/218 |
| 4,321,785 | A | * | 3/1982 | Kaland | 56/17.2 |
| 4,836,707 | A | * | 6/1989 | Myers | 403/322 |
| 5,598,724 | A | * | 2/1997 | Primeau | 70/177 |

FOREIGN PATENT DOCUMENTS

| | | | | |
|---|---|---|---|---|
| CH | 626134 | | 10/1981 | E05C/3/28 |
| FR | 1461481 | * | 9/1965 | 70/208 |
| GB | 2272478 | * | 5/1994 | 292/336.3 |
| GB | 2275734 | | 7/1994 | E05B/1/00 |

* cited by examiner

*Primary Examiner*—Lynne H. Browne
*Assistant Examiner*—John B. Walsh
(74) *Attorney, Agent, or Firm*—Abelman, Frayne & Schwab

(57) ABSTRACT

The invention concerns a handle (1, 1') for use in a locking mechanism (10, 10'), which handle comprises a lever (7, 7') adjacent one end of which is located a cam (4, 4') for activating said locking mechanism, and a connecting portion (5, 5') intermediate to and unitary with the cam and the lever. In the locking mechanism, the handle is rotatably mounted in the housing (11, 11') of the locking mechanism, the cam of the handle being provided on the inside of the housing and between two pawls (19, 19') mounted for pivotal movement in mutually opposed directions between a first locking position and a second position for securing a locking member in the locking position, the pawls being biased towards said locking position by resilient biasing means (21, 21'). Relative rotation between the handle and the housing permits the locking member to be released from the locking position.

10 Claims, 3 Drawing Sheets

HANDLE

The present invention is concerned with a handle and, in particular, with a handle which may be used in a locking mechanism.

Various types of locking mechanisms and handles for using therewith are known. One such mechanism is disclosed in Swiss Patent No. 626134. This document describes a locking mechanism for locking two parts which can move relative to one another. The locking mechanism is suitable for use in the transport industry and, more particularly, the air travel industry. In view of the high demands placed on locks in the airline industry, only those locks which have satisfied specific testing requirements in terms of increased security are permissible. Security of locking devices is of paramount importance to safety in the airline industry.

Previous handles used in locking mechanisms of the type disclosed in Swiss Patent No. 626134 generally comprise a lever or the like having a bore therethrough for receiving a bolt or locking pin, the bolt or locking pin securing the lever to the housing of the locking mechanism passing through an aperture or bore in both the housing of the locking mechanism and a cam positioned on the inside of the housing. A cap screw or a nut or the like is then fastened on the end of the bolt or locking pin passing through the cam. Therefore handles for use in locking mechanisms of the type disclosed in Swiss Patent No. 626134 typically comprise a plurality of individual components fixed relative to one another.

Handles of this type generally have longer assembly times and increase the risk of failure in view of the amount of individual components.

The present inventors have now devised a handle for use in a locking mechanism which alleviates such disadvantages and which is particularly advantageous in terms of its relative ease of assembly.

Therefore, according to a first aspect of the present invention there is provided a handle for use in a locking mechanism, said handle comprising a cam for actuating said locking mechanism, adjacent which is located an elongate portion or lever, and a connecting portion intermediate to and unitary with said cam and said elongate portion. Thus, advantageously, the handle according to the present invention obviates the need for assembly of individual components and which offers increased security when used in locking mechanisms, such as for example, in the airline industry.

Preferably, the handle further comprises a flange on said connecting portion for abutting an outer surface of a housing of said locking mechanism, which advantageously, may stabilize the handle against the housing of the locking mechanism. In one embodiment, the longitudinal axis of said lever is substantially parallel to the longitudinal axis of said cam. In another embodiment, the longitudinal axis of said lever is substantially perpendicular to the longitudinal axis of said cam. Rotation of the lever in a particular plane advantageously permits rotation of the cam in a plane parallel thereto. Preferably, the handle according to the invention is formed by injection moulding of a suitable material such as stainless steel or a rigid plastic or the like.

The handle according to the present invention, may advantageously, be included in a suitable locking mechanism. Therefore, according to a second aspect of the present invention there is provided a locking mechanism comprising:

(a) a handle rotatably mounted in a housing of said locking mechanism, (b) the cam of said handle being provided on the inside of said housing and between two pawls mounted for pivotal movement in mutually opposed directions between a first locking position and a second open position for securing a locking member in said locking position, said pawls being biased toward said locking position by resilient biasing means, relative rotation between said handle and said housing permitting said locking member to be released from said locking position.

Preferably, the rotation of the handle in the housing causes the locking member to be released from the locking position.

Preferably, the resilient biasing means comprises spring biasing means which is preferably a compression, helical or strip spring or the like. The pawls are, advantageously, pivotable about their ends remote from the end of the pawls engaging the locking member, within a bearing surface provided in the housing, and which pawls, preferably, each comprise a strip disposed in an axis parallel to said cam.

In a particularly preferred embodiment of this aspect of the invention the housing of the locking mechanism comprises an aperture which is shaped and dimensioned to receive said handle therein, which aperture is such that entry into and exit from said housing is possible only at a particular orientation of said handle relative to the housing.

This embodiment of this aspect of the invention is particularly advantageous because the handle and the housing of the locking mechanism thus constitute a self-locating assembly which may only be dismantled when the handle is in a particular position in the housing. Advantageously, the handle may only be removed or inserted into the aperture of said housing when the locking mechanism is being assembled or dismantled. Preferably, the orientation of said aperture is such that when the pawls are positioned within the housing, the handle cannot be removed from the aperture. Thus, advantageously, the locking mechanism according to the invention provides increased security whilst the possibility of the locking mechanism failing is substantially reduced. The locking mechanism is also particularly advantageous in terms of its relative ease of manufacture and subsequent assembly.

Preferably, the handle of the locking mechanism is rotatable within the housing in a plane parallel to the outer surface of the housing, about an axis of rotation corresponding to the central axis of said connection portion. One end of the housing of the locking mechanism is optionally arcuate and corresponding to the arc of rotation of said handle. The handle advantageously also further comprises guide means, such as a guide rail or flange or the like for engaging the housing, to facilitate rotation of said handle on the arcuate end of the housing and to secure the handle thereto. A recess is also provided in the inside of said housing for receiving the locking member which preferably is located on a door or the like to be locked using the locking mechanism according to the invention.

According to a further aspect of the present invention there is also provided a self-locating assembly for a locking mechanism according to the invention, which assembly comprises a handle according to the invention and a housing for a locking mechanism having an aperture therein shaped and dimensioned for receiving said handle such that entry into and exit from said housing is possible only at a particular orientation of said handle. This assembly is particularly advantageous for use in a locking mechanism according to the invention in terms of the increased security provided by such locking mechanisms. Such an assembly is also particularly advantageous as regards its relative ease of manufacture compared to previous locking devices.

The invention will now be described in more detail with reference to the accompanying drawings and which description is purely exemplary, wherein.

Figure 1:
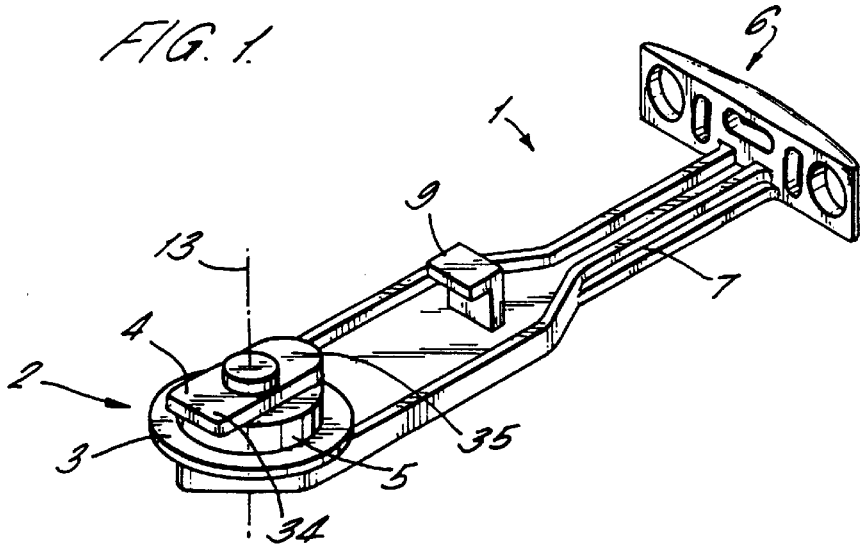
FIG. 1 is a perspective view of a handle according to a first embodiment of the invention.
Figure 2:
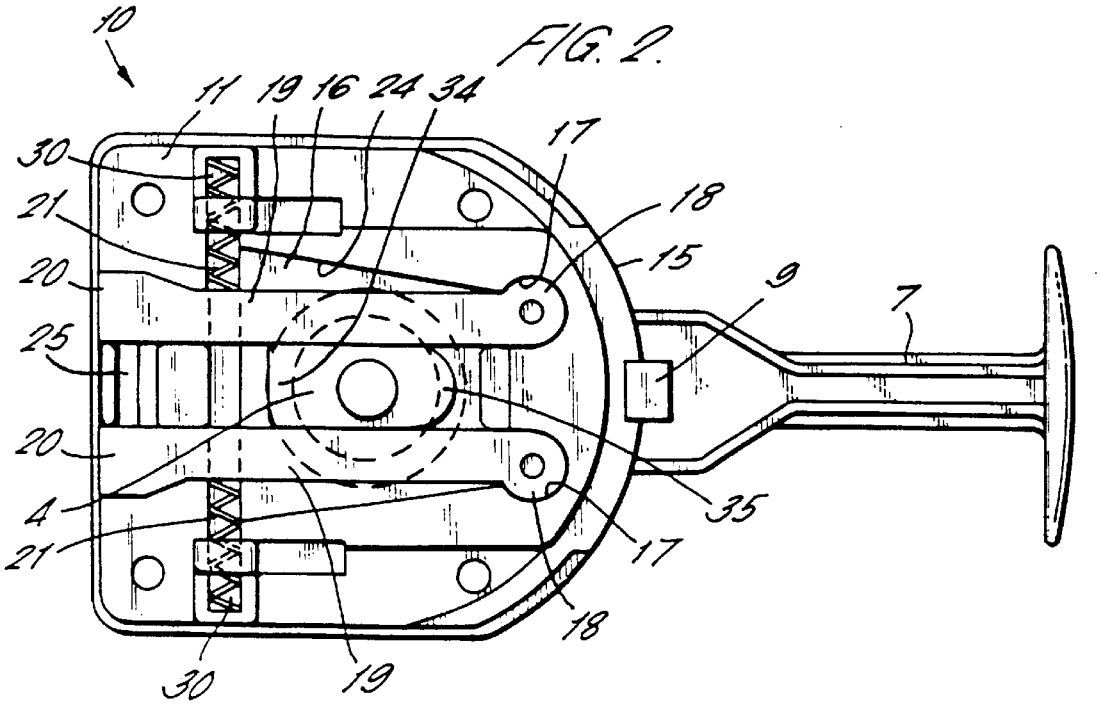
FIG. 2 is a vertical view of a locking mechanism according to the first embodiment of the invention.

Referring to the drawings, the first embodiment of the invention provides in FIG. 1 a handle generally designated by the reference numeral 1 for use in a locking mechanism generally designated 10 in FIG. 2, which handle comprises, a lever 7. At one end 2 of the handle 1 is located a circular flange 3 for abutting a housing 11 of the locking mechanism. A cam 4 is located on the flange 3 by a connecting disc 5 which is of sufficient length to traverse an aperture 12 in the housing 11.

The lever 7, the flange 3, cam 4 and disc 5 which form the handle 1 are all unitary with one another being formed by injection moulding of stainless steel or rigid plastic material as appropriate. The housing is also made of a suitably rigid material such as stainless steel or plastic material.

A guide rail 9 is provided on the lever 7 to secure the handle to the housing 11 of the locking mechanism 10. The guide rail also facilitates rotation of the handle on the housing 11 about the axis of rotation 13 of the handle. The housing has a curved end 15. Generally, the housing 11 is fixed, in a door or the like (not shown) for receipt of a locking member or latch secured on a wall or the like.

A recess 16 is provided on the inside of the housing 11 which recess comprises two generally circular bulges 17 for receipt of a complementary shaped end 18 of a strip-like pawl 19 mounted therein. Each bulge 17 together with the circular end 18 of the pawl 19 forms a pivot bearing for the pawls. The ends 20 of the pawls 19 are biased towards a locking position by a helical spring 21 located between the pawl 19 and the wall of a recess 30 within which the spring is located. The cam 4 of the handle 1 is rotatably disposed between each of the pawls 19.

Figure 5:
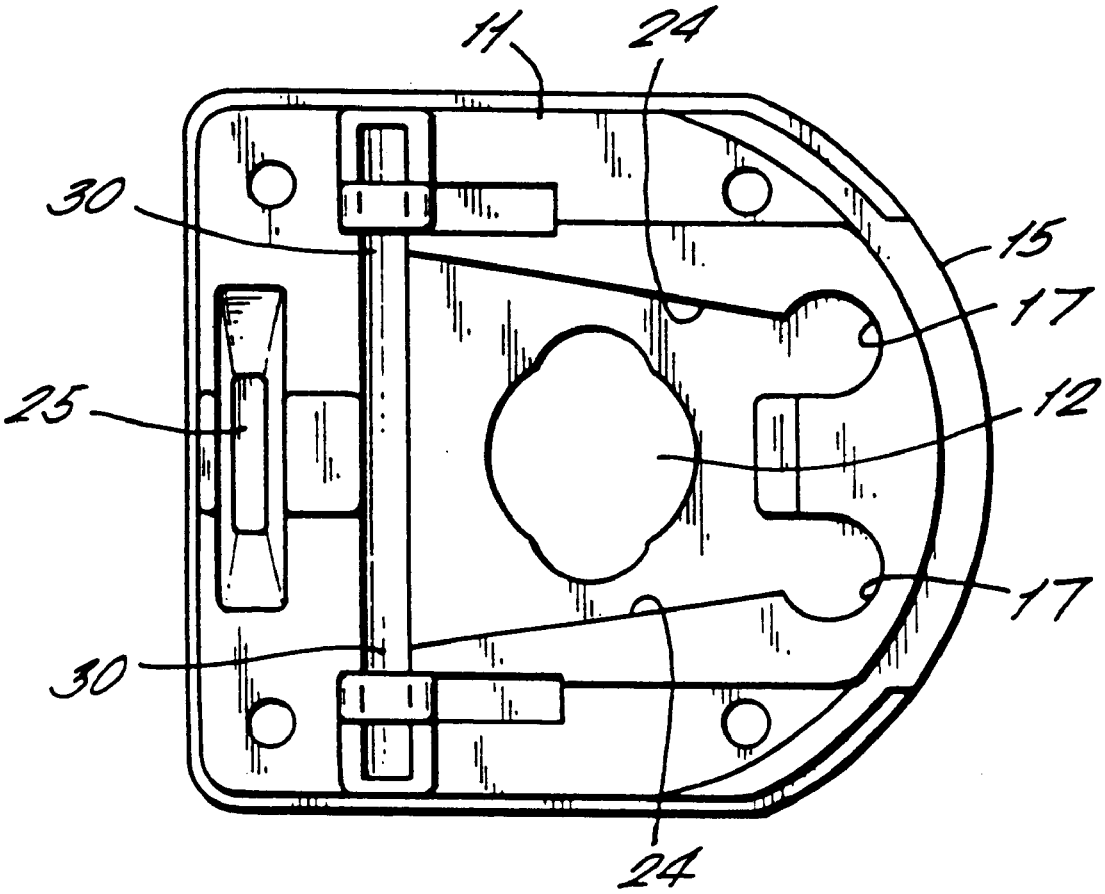
FIG. 5 is a vertical view of a self-locating assembly according to the invention.

The aperture 12 of the housing 11 is shaped and dimensioned to receive the handle 1 only when the handle is in a particular orientation relative to the housing 11 which position is generally in an axis perpendicular to that of the pawls when mounted in the housing biased towards the locking position. The handle 1 can only be inserted into and withdrawn from the aperture of the housing 11 before or after the pawls 19 are positioned or removed from the bulges 17 respectively. When the pawls 19 are present in the bulges 17 the handle 1 never reaches the correct position within the housing permitting its removal from the aperture 12, the pawls 19 on each side of the cam 4 preventing its removal. This is a particular advantage of the locking mechanism according to the invention, which confers increased security to the locking mechanism. The arrangement of the aperture in the housing 11 is shown in more detail in FIG. 5.

Figure 3:
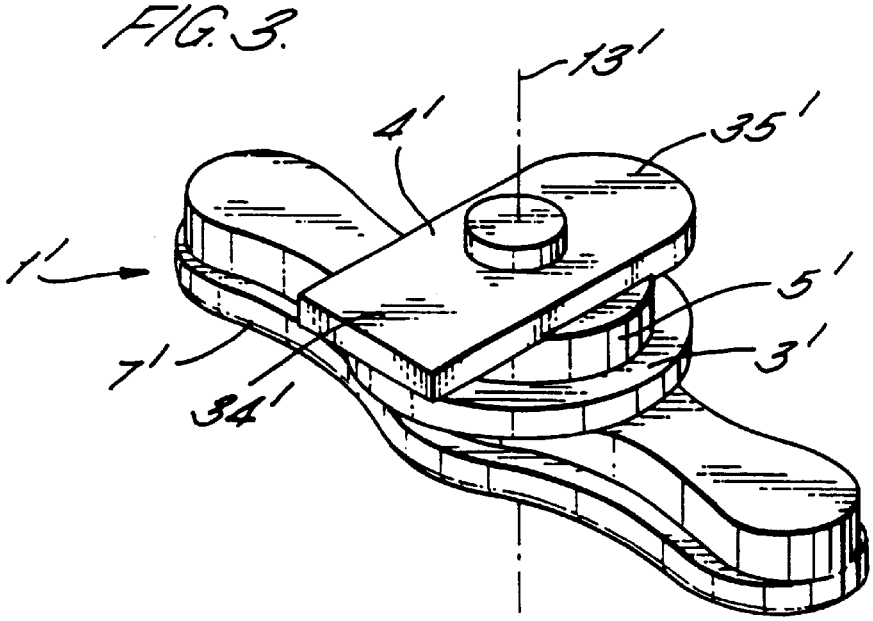
FIG. 3 is a perspective view of a handle according to a second embodiment of the invention.
Figure 4:
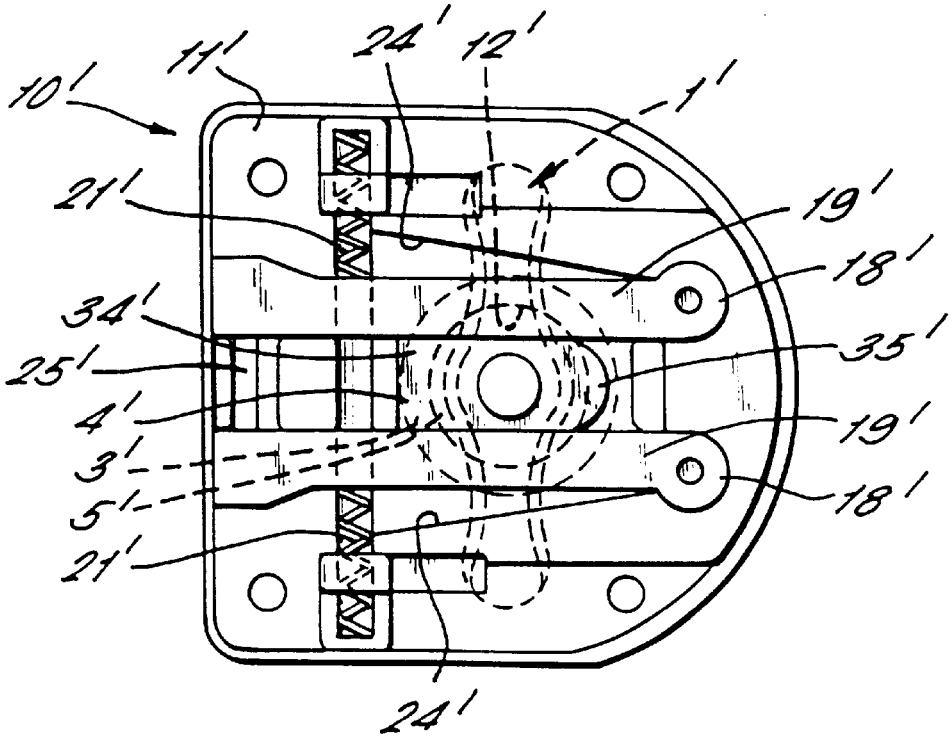
FIG. 4 is a vertical view of a locking mechanism according to the second embodiment of the invention.

FIGS. 3 and 4 show a second embodiment of the invention. The locking mechanism 10' of the second embodiment is the same as that of the first embodiment except for handle 1'. Handle 1' comprises a circular flange 3', cam 4' and connecting disc 5' as in the first embodiment. However, lever 7' is truncated compared to lever 7 of the first embodiment and orientated substantially perpendicularly to the orientation of lever 7 when assembled with locking mechanism 10'. Lever 7', flange 3', cam 4' and disc 5' are all unitary with one another as in the first embodiment and are formed using similar methods and materials.

The means of assembling and retaining handle 1' with locking mechanism 10' are the same as in the first embodiment except that handle 1' is shaped to be received in aperture 12' of the housing 11' only when the handle is orientated with its axis generally parallel to that of the pawls 19' rather than perpendicular as in the first embodiment.

In use the handle 1, 1' of the first or second embodiment is rotated about the central axis of rotation 13, 13' of the connecting disc 5, 5' of the handle 1, 1'. The ends 34, 34' and 35, 35' of the cam 4, 4' thus impinge on respective pawls 19, 19' to deflect them about the pivot bearing 18, 18'. The cam 4, 4' is of suitable dimensions to deflect each of the pawls in mutually opposed directions irrespective of the direction of rotation of the lever 7, 7' in the housing.

A locking pin (not shown) or catch is maintained between the pawls 19, 19' in the locking position and comprises any suitable complementary engaging formation, such that when the pin impinges on said pawls they are deflected to the open position abutting the wall 24, 24' of the recess 16, 16'. Once the catch enters the aperture 25, 25', the pawls 19, 19' move back to the original locking position by the action of the helical springs 21, 21' to secure the catch between pawls 19, 19'. Accordingly, complementary grooves may be provided on the catch into which the pawls 19, 19' can move to secure the catch therebetween.

What is claimed is:

1. A locking mechanism (10, 10') comprising:

(a) a handle (7, 7') comprising a cam for activating said locking mechanism, adjacent which is located a lever having a longitudinal axis, said handle including a connecting portion intermediate to and unitary with said cam and lever, wherein the cam, the connecting portion and the lever form a single element; said handle rotatably mounted in a housing (11, 11') of said mechanism, (b) the cam of said handle being provided on the inside of said housing and between two pawls (19, 19') mounted for pivotal movement in mutually opposed directions between a first locking position and a second open position for securing a locking member in said locking position, said pawls being biased toward said locking position by resilient biasing means (21, 21'), relative rotation between said handle and said housing permitting said locking member to be released from said locking position.

2. A locking mechanism (10, 10') according to claim 1, wherein said handle is rotated relative to said housing.

3. A locking mechanism (10, 10') according to claim 2, wherein said pawls are pivotable about their ends (18, 18') remote from said locking member in a bearing surface provided in said housing.

4. A locking mechanism (10, 10') according to claim 1, wherein each of said pawls comprises a strip disposed in an axis parallel to the longitudinal axis of said cam.

5. A locking mechanism (10, 10') according to claim 1, wherein said housing comprises an aperture (12, 12') shaped and dimensioned to receive said handle therein, which aperture is such that entry into and exit from said housing is possible only at a particular orientation of said handle relative to said housing.

6. A locking mechanism (10, 10') according to claim 1, wherein said handle is rotatable in said housing in a plane parallel to an outer surface of said housing.

7. A locking mechanism (10, 10') according to claim 1, wherein said housing is substantially arcuate at an end of the housing (15, 15') remote from said locking member.

8. A locking mechanism (10) according to claim 7, wherein said handle (1) further comprises guide means (9) for engaging said arcuate end (15) of said housing.

9. A locking mechanism (10, 10') according to claim 1 further comprising a recess (16, 16') on the inside of said housing for reception of said locking member.

10. A self-locating assembly for a locking mechanism (10, 10') according to claim 1, which assembly comprises the handle (1, 1') and the housing (11, 11') for the locking mechanism (10, 10') having an aperture (12, 12') therein shaped and dimensioned for receiving said handle such that entry into and exit from said handle is possible at a particular orientation of said handle.

* * * * *

UNITED STATES PATENT AND TRADEMARK OFFICE

CERTIFICATE OF CORRECTION

PATENT NO. : 6,354,640 B2
DATED : March 12, 2002
INVENTOR(S) : Ming Xing Xie et al.

It is certified that error appears in the above-identified patent and that said Letters Patent is hereby corrected as shown below:

Title page,
Insert -- [30] Foreign Application Priority Data
February 16, 1998 (SG) ..... S 98 00 333-8 --.

Signed and Sealed this

Twenty-ninth Day of October, 2002

*Attest:*

*Attesting Officer*

JAMES E. ROGAN
*Director of the United States Patent and Trademark Office*